US012604981B2

(12) United States Patent
Chen et al.

(10) Patent No.: US 12,604,981 B2
(45) Date of Patent: Apr. 21, 2026

(54) SLIDE RAIL ASSEMBLY

(71) Applicants: King Slide Works Co., Ltd., Kaohsiung City (TW); King Slide Technology Co., Ltd., Kaohsiung City (TW)

(72) Inventors: Ken-Ching Chen, Kaohsiung City (TW); Shun-Ho Yang, Kaohsiung City (TW); Tzu-Cheng Weng, Kaohsiung City (TW); Kai-Wen Yu, Kaohsiung City (TW); Chun-Chiang Wang, Kaohsiung City (TW)

(73) Assignees: King Slide Works Co., Ltd., Kaohsiung City (TW); King Slide Technology Co., Ltd., Kaohsiung City (TW)

( * ) Notice: Subject to any disclaimer, the term of this patent is extended or adjusted under 35 U.S.C. 154(b) by 71 days.

(21) Appl. No.: 18/588,529

(22) Filed: Feb. 27, 2024

(65) Prior Publication Data

US 2025/0151898 A1 May 15, 2025

(30) Foreign Application Priority Data

Nov. 9, 2023 (TW) ..... 112143584

(51) Int. Cl.
*A47B 88/473* (2017.01)
*A47B 88/483* (2017.01)

(52) U.S. Cl.
CPC ..... *A47B 88/473* (2017.01); *A47B 88/483* (2017.01); *A47B 2210/0018* (2013.01)

(58) Field of Classification Search
CPC ..... A47B 88/473; A47B 88/483; A47B 2210/0018; A47B 2088/4235; A47B 88/50; A47B 2210/0016
See application file for complete search history.

(56) References Cited

U.S. PATENT DOCUMENTS

RE28,344 E * 2/1975 Monaco ..... F16C 29/02 384/21
6,560,114 B2 * 5/2003 Berry ..... H05K 7/1489 361/740
6,883,884 B2 * 4/2005 Chen ..... A47B 88/423 312/334.44
7,452,040 B1 * 11/2008 Burgess, III ..... A47B 88/49 312/319.1
8,282,176 B1 * 10/2012 Chen ..... A47B 88/493 312/334.46
8,317,278 B2 * 11/2012 Enos ..... A47B 88/493 312/334.47

(Continued)

FOREIGN PATENT DOCUMENTS

CA 2687402 C 10/2014
TW 201221087 A * 6/2012

(Continued)

*Primary Examiner* — Hanh V Tran
(74) *Attorney, Agent, or Firm* — Best & Flanagan LLP

(57) ABSTRACT

A slide rail assembly includes a first rail, a second rail and a handle. The second rail is movable relative to the first rail. The handle is pivotally connected to the second rail through a shaft member and movable to switch between a first state and a second state. The shaft member is arranged in a direction substantially identical to a moving direction of the second rail relative to the first rail.

12 Claims, 14 Drawing Sheets

(56) References Cited

U.S. PATENT DOCUMENTS

| | | | | |
|---|---|---|---|---|
| 9,723,745 | B2 * | 8/2017 | Qi | G06F 1/18 |
| 9,894,798 | B2 * | 2/2018 | Chen | A47B 88/90 |
| 10,028,406 | B2 * | 7/2018 | Chen | H05K 7/1489 |
| 10,098,459 | B2 * | 10/2018 | Chen | A47B 96/067 |
| 10,264,698 | B2 * | 4/2019 | Kho | H05K 7/1492 |
| 10,390,617 | B2 * | 8/2019 | Chen | A47B 88/43 |
| 10,499,527 | B2 * | 12/2019 | Liao | H05K 7/1489 |
| 10,631,639 | B2 * | 4/2020 | Chen | H05K 7/1489 |
| 11,197,389 | B2 * | 12/2021 | Lin | A47B 88/437 |
| 11,382,233 | B2 * | 7/2022 | Chang | H05K 7/1489 |
| 2012/0076446 | A1 * | 3/2012 | Chen | A47B 88/43 384/21 |
| 2022/0160127 | A1 * | 5/2022 | Chen | A47B 88/423 |
| 2022/0369478 | A1 * | 11/2022 | Li | H05K 7/20272 |
| 2024/0188715 | A1 * | 6/2024 | Chen | A47B 95/02 |
| 2024/0188716 | A1 * | 6/2024 | Chen | A47B 88/49 |
| 2024/0240669 | A1 * | 7/2024 | Chen | A47B 88/423 |
| 2024/0410421 | A1 * | 12/2024 | Chen | H05K 7/1489 |
| 2025/0137488 | A1 * | 5/2025 | Chen | A47B 88/50 |

FOREIGN PATENT DOCUMENTS

| | | | | |
|---|---|---|---|---|
| TW | I604775 B | * | 11/2017 | E05C 19/06 |
| TW | I689238 B | * | 3/2020 | H05K 7/1489 |
| TW | I733625 B | * | 7/2021 | A47B 88/49 |

* cited by examiner

SLIDE RAIL ASSEMBLY

BACKGROUND OF THE INVENTION

1. Field of the Invention

The present invention relates to a slide rail assembly, and more particularly, to a slide rail assembly having a handle to facilitate a user to operate and move a slide rail.

2. Description of the Prior Art

U.S. Pat. No. 10,631,639B2 discloses a slide rail assembly comprising a first rail, a second rail, a blocking member and an operating member. The second rail and the first rail are longitudinally movable relative to each other. The blocking member is coupled to the first rail. The operating member can enter a predetermined state with respect to the second rail. When the second rail is located at a predetermined position with respect to the first rail, the operating member is in the predetermined state and blocked by the blocking member to prevent the second rail from displacement from the predetermined position in a predetermined direction. When the operating member is not in the predetermined state and hence not blocked by the blocking member, the second rail can be displaced from the predetermined position in the predetermined direction. The operating member is pivotally connected to the second rail through a shaft, and the shaft is arranged in a direction substantially identical to a lateral direction (or transverse direction) of the second rail. As such, when the operating member is operated by a user, the operating member is rotated to move along a height direction of the second rail.

However, for different market requirements, it is important to develop various slide rail products.

SUMMARY OF THE INVENTION

The present invention provides a slide rail assembly having a handle to facilitate a user to operate and move a slide rail.

According to an embodiment of the present invention, a slide rail assembly comprises a first rail, a second rail and a handle. The second rail is movable relative to the first rail. The handle is pivoted to the second rail through a shaft member and movable relative to the second rail to switch between a first state and a second state. The shaft member is arranged in a direction substantially identical to a moving direction of the second rail relative to the first rail.

According to another embodiment of the present invention, a slide rail assembly comprises a first rail, a second rail and a handle. The second rail is movable relative to the first rail. The handle is movable relative to the second rail to switch between a first state and a second state. The second rail has an outer side and an inner side opposite to each other, and the outer side is adjacent to and faces toward the first rail. The handle has a first end, a second end and an operating section connected between the first end and the second end. When the handle is in the second state, the operating section of the handle is extended beyond the inner side of the second rail by a predetermined distance.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
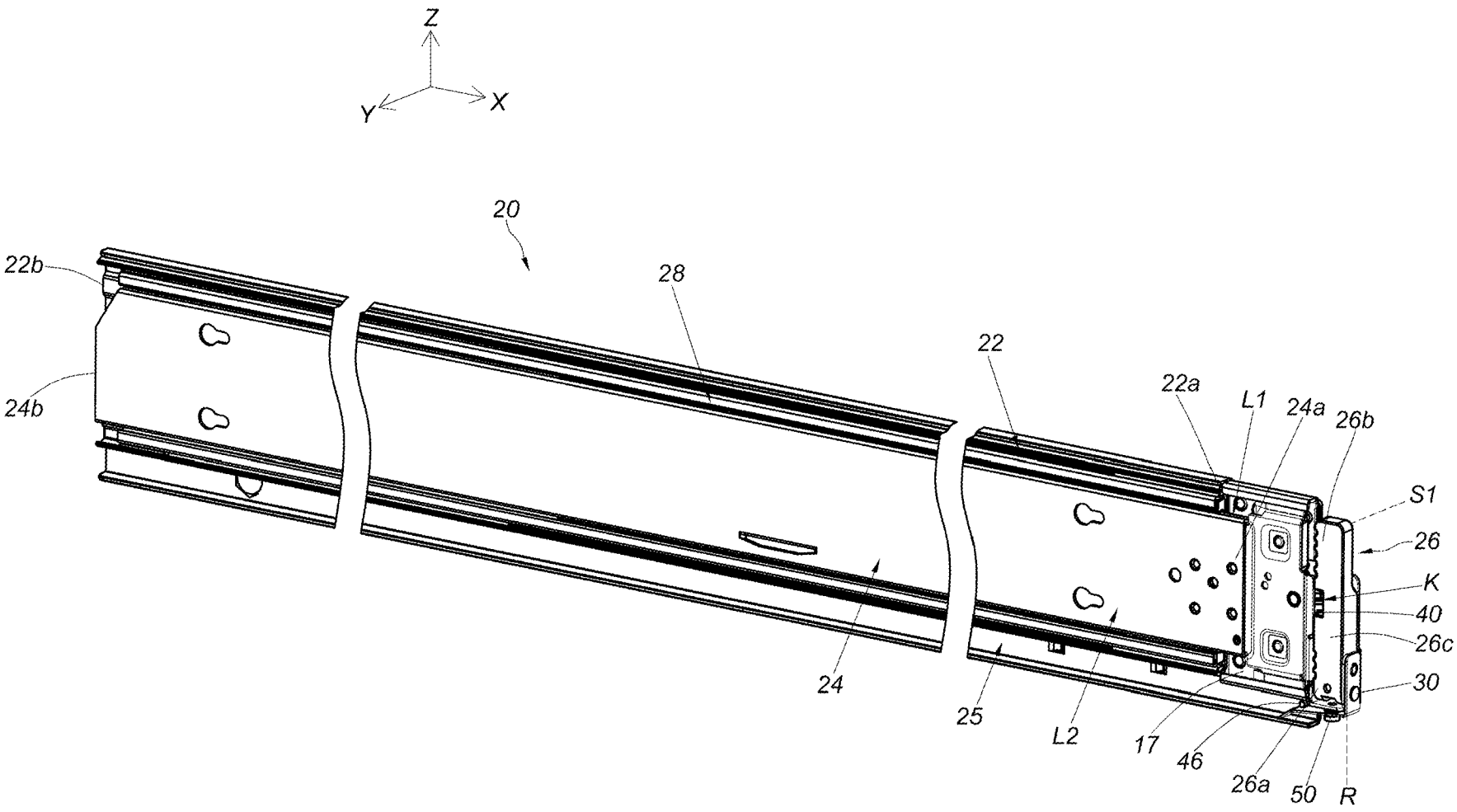
FIG. 1 is a diagram showing a slide rail assembly with a handle in a first state according to a first embodiment of the present invention.
Figure 2:
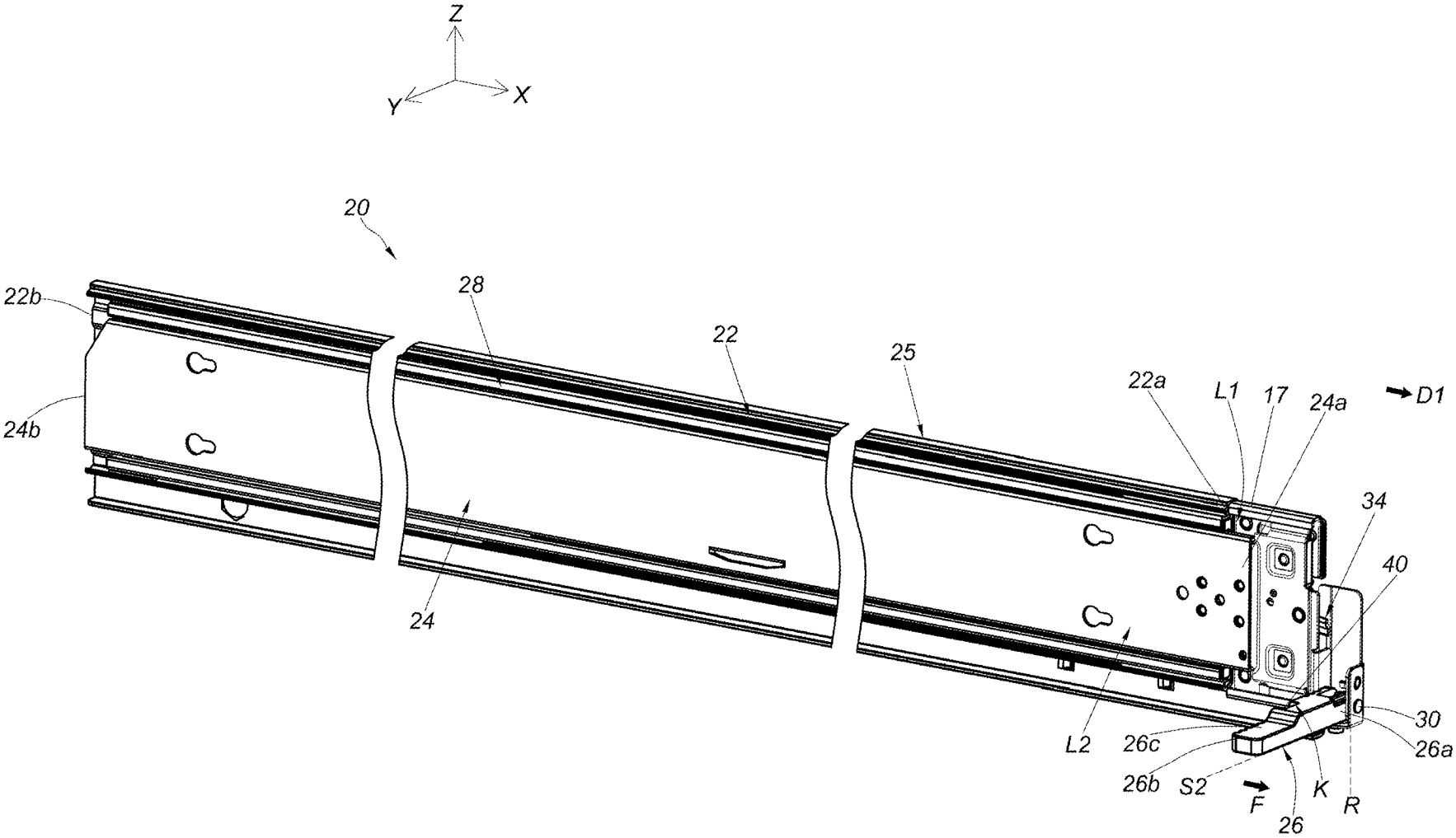
FIG. 2 is a diagram showing the slide rail assembly with the handle in a second state according to the first embodiment of the present invention.

As shown in FIG. 1 and FIG. 2, a slide rail assembly 20 comprises a first rail 22, a second rail 24 and a handle 26 according to a first embodiment of the present invention. Preferably, the slide rail assembly 20 further comprises a third rail 28 movably mounted between the first rail 22 and the second rail 24. In FIG. 1 and FIG. 2, the second rail 24 is located at a retracted position R relative to the first rail 22. The second rail 24 is longitudinally movable relative to the first rail 22. In the figures, the X axis is a longitudinal direction (or a length direction or a moving direction of the slide rail), the Y axis is a transverse direction (or a lateral direction of the slide rail), and the Z axis is a vertical direction (or a height direction of the slide rail).

The handle 26 is movable relative to the second rail 24. More particularly, the handle 26 is pivoted to the second rail 24 through a shaft member 30, such that the handle 26 is movable to switch between a first state S1 (as shown in FIG. 1) and a second state S2 (as shown in FIG. 2). The shaft member 30 is arranged in a direction substantially identical to a moving direction of the second rail 24 relative to the first rail 22. In other words, the shaft member 30 is arranged in a direction substantially identical to a length direction of the second rail 24 (or the longitudinal direction or the X axis direction). Furthermore, when the handle 26 is in the second state S2, a user can apply a force F to the handle 26 along an opening direction D1 (for example, the user can easily hold the handle 26 in the second state S2 to apply the force F as shown in FIG. 2), such that the second rail 24 can be easily pulled out relative to the first rail 22 along the opening direction D1.

Preferably, when the handle 26 is in the first state S1 (as shown in FIG. 1), the handle 26 is arranged in a direction substantially identical to a height direction of the second rail 24 (or the Z axis direction).

Preferably, when the handle 26 is in the second state S2 (as shown in FIG. 2), the handle 26 is arranged in a direction substantially identical to a transverse direction of the second rail 24 (or the Y axis direction).

Preferably, the moving direction of the second rail 24 relative to the first rail 22, the height direction of the second rail 24 and the transverse direction of the second rail 24 are perpendicular to each other.

Preferably, the second rail 24 has an outer side L1 and an inner side L2 opposite to each other. The outer side L1 is adjacent to and faces toward the first rail 22 (or the third rail 28). Furthermore, the first rail 22 has a first end part 22*a* and a second end part 22*b* opposite to each other, such as a front end part and a rear end part. Similarly, the second rail 24 has a first end part 24*a* and a second end part 24*b* opposite to each other, such as a front end part and a rear end part.

Figure 3A:
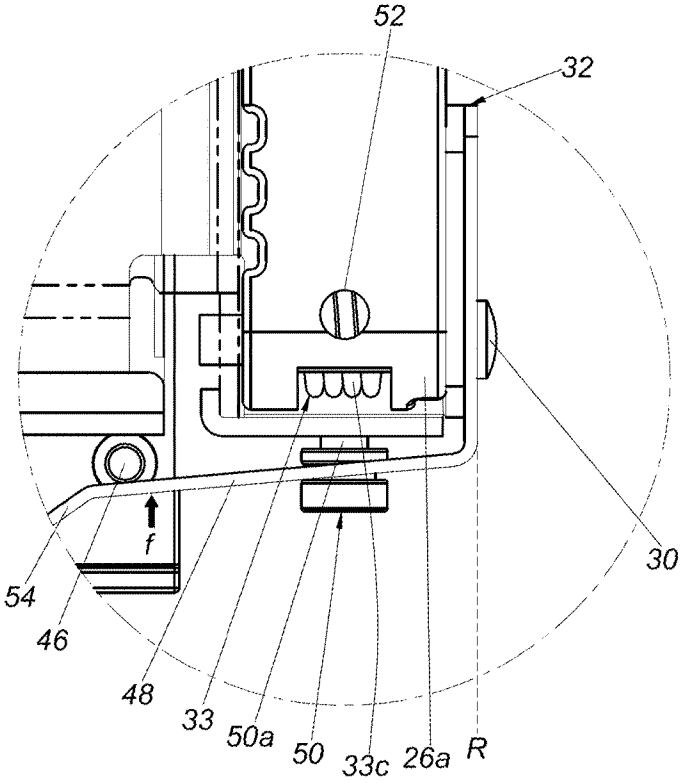
FIG. 3A is an enlarged view of an area A of FIG. 3.
Figure 3:
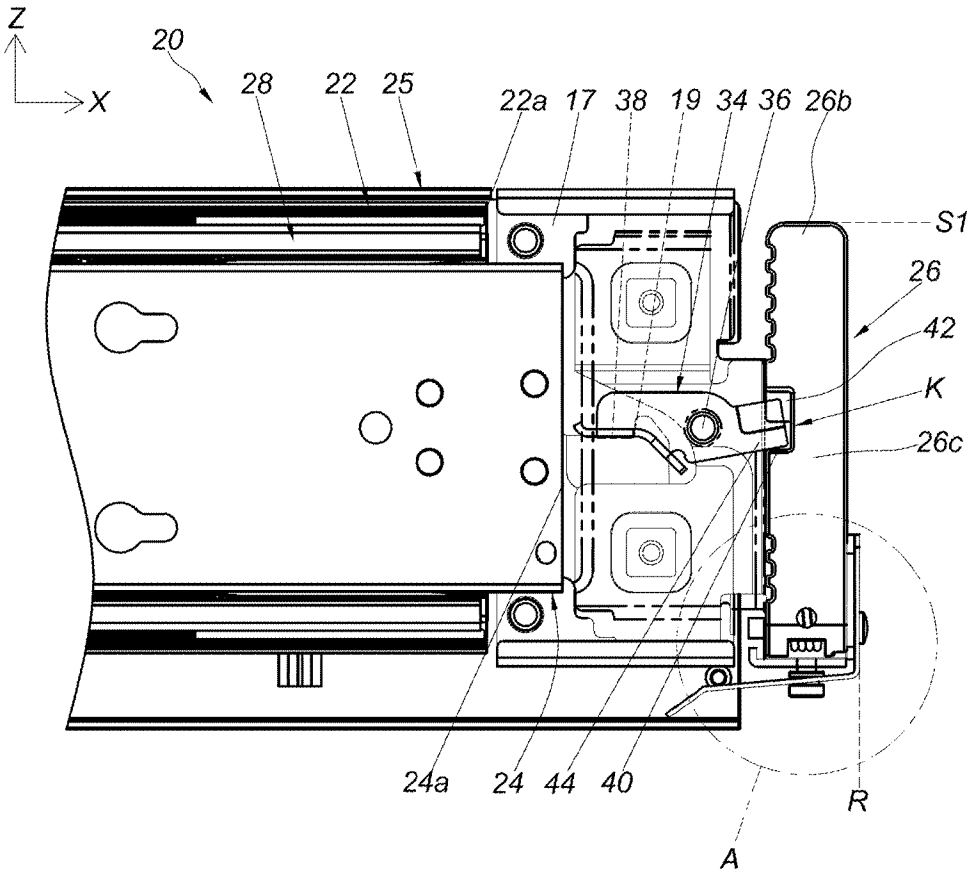
FIG. 3 is a diagram showing a second rail located at a retracted position relative to a first rail of the slide rail assembly with the handle in the first state according to the first embodiment of the present invention.
Figure 4A:
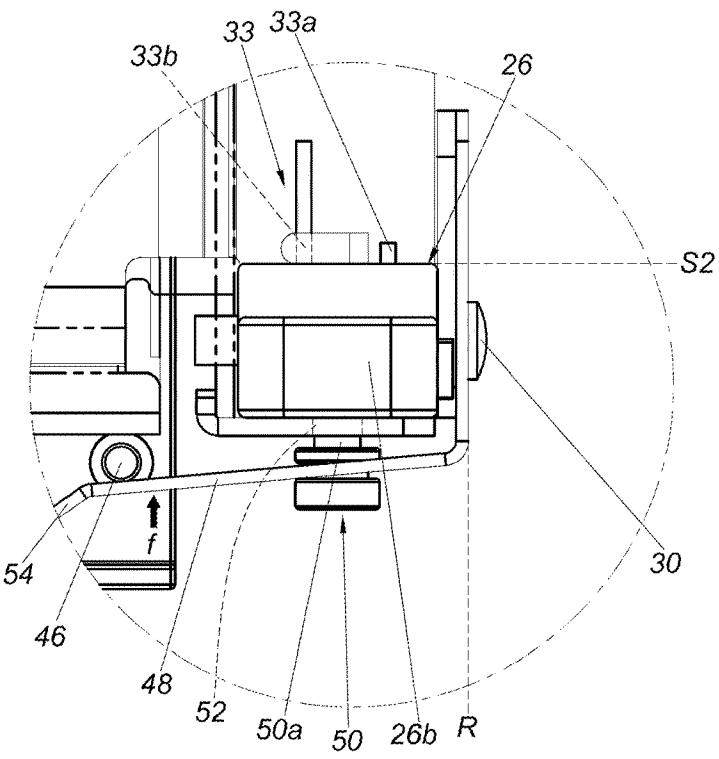
FIG. 4A is an enlarged view of an area A of FIG. 4.
Figure 4:
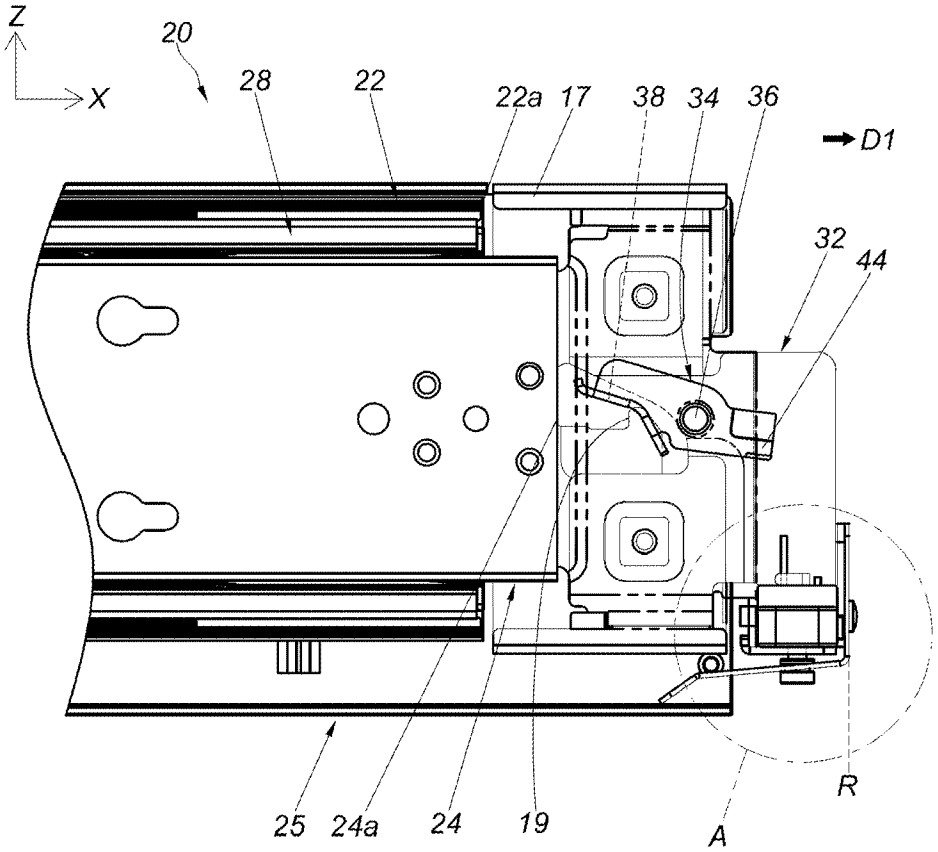
FIG. 4 is a diagram showing the second rail located at the retracted position relative to the first rail of the slide rail assembly with the handle in the second state configured to unlock the second rail from the first rail according to the first embodiment of the present invention.

As shown in FIG. 3 and FIG. 4, the first rail 22 is arranged with a bracket 25. The bracket 25 is connected (such as fixedly connected) to the first rail 22 to be seen as a part of the first rail 22. Preferably, the first rail 22 comprises a blocking part 19. The blocking part 19 is arranged on one of the first rail 22 and the bracket 25. In the present embodiment, the blocking part 19 is arranged on an extension component 17 of the bracket 25, and the blocking part 19 is adjacent to the first end part 22*a* of the first rail 22.

The handle 26 is rotatable to switch between the first state S1 (as shown in FIG. 3) and the second state S2 (as shown in FIG. 4) through the shaft member 30. The handle 26 comprises a first end 26*a*, a second end 26*b* and an operating section 26*c* connected between the first end 26*a* and the second end 26*b* (as shown in FIG. 3 and FIG. 3A). The shaft member 30 is adjacent to the first end 26*a* of the handle 26. The handle 26 is pivoted to a connecting component 32 on the second rail 24 through the shaft member 30. The connecting component 32 is connected (such as fixedly connected) to the second rail 24 to be seen as a part of the second rail 24. When the handle 26 is in the second state S2, the operating section 26*c* of the handle 26 is configured to be held by the user to pull out the second rail 24 from the retracted position R along the opening direction D1 relative to the first rail 22 (please also refer to FIG. 4 and FIG. 2).

Preferably, the slide rail assembly 20 further comprises an elastic member 33 (as shown in FIG. 3A). The handle 26 is configured to be held at the first state S1 in response to an elastic force of the elastic member 33. The elastic member 33 can be a torsion spring, or other object with elasticity, but the present invention is not limited thereto. The elastic member 33 comprise a first elastic section 33*a*, a second elastic section 33*b* (as shown in FIG. 4A) and a middle section 33*c* (as shown in FIG. 3A) connected between the first elastic section 33*a* and the second elastic section 33*b*. The middle section 33*c* is arranged on a main body of the shaft member 30. The first elastic section 33*a* is configured to abut against the handle 26, and the second elastic section 33*b* is configured to abut against the connecting component 32 on the second rail 24; or the second elastic section 33*b* is configured to abut against the handle 26, and the first elastic section 33*a* is configured to abut against the connecting component 32 on the second rail 24.

Preferably, the slide rail assembly 20 further comprises a locking member 34 movably mounted on the second rail 24. In the present embodiment, the locking member 34 is pivoted to the connecting component 32 on the second rail 24 through an auxiliary shaft 36. In other words, the locking member 34 is pivoted to the second rail 24. The auxiliary shaft 36 is arranged in a direction substantially identical to the transverse direction of the second rail 24 (or the Y axis direction). When the second rail 24 is located at the retracted position R relative to the first rail 22, a locking part 38 of the locking member 34 is configured to be blocked by the blocking part 19 in order to prevent the second rail 24 from being moved away from the retracted position R relative to the first rail 22 (as shown in FIG. 3).

Preferably, the handle 26 comprises a supporting feature 40. The supporting feature 40 has a guiding part (such as an inclined surface or an arc surface). When the second rail 24 is located at the retracted position R relative to the first rail 22 and when the handle 26 is in the first state S1, the handle 26 is configured to support the locking member 34 through the supporting feature 40, in order to hold the locking member 38 to be blocked by the blocking part 19 (as shown in FIG. 3).

Preferably, the handle 26 further comprises a guiding feature 42. The guiding feature 42 has an inclined surface or an arc surface. The guiding feature 42 and the supporting feature 40 together define a predetermined space K configured to accommodate an extension part 44 of the locking member 34, such that the extension part 44 can be supported by the supporting feature 40 of the handle 26. The auxiliary shaft 36 is located between the locking part 38 and the extension part 44 (as shown in FIG. 3).

Preferably, during a process of moving the handle 26 to switch from the first state S1 (as shown in FIG. 3 and FIG. 3A) to the second state S2 (as shown in FIG. 4 and FIG. 4A), the handle 26 is configured to move the extension part 44 of the locking member 34 through the guiding feature 42 (as shown in FIG. 3 and FIG. 3A), in order to drive the locking member 34 to rotate a predetermined angle. Moreover, the supporting feature 40 of the handle 26 no longer supports the extension part 44 of the locking member 34, such that the locking part 38 of the locking member 34 is no longer blocked by the blocking part 19, in order to allow the second rail 24 to be moved away from the retracted position R along the opening direction D1 relative to the first rail 22 (as shown in FIG. 4 and FIG. 4A).

Preferably, the first rail 22 is arranged with an auxiliary structure 46. In the present embodiment, the auxiliary structure 46 is arranged on the bracket 25 of the first rail 22, and the auxiliary structure 46 is a pin, but the present invention is not limited thereto. The auxiliary structure 46 is laterally (transversely) protruded relative to the first rail 22. The second rail 24 is arranged with an auxiliary elastic member 48. The auxiliary elastic member 48 is arranged with a first predetermined feature 50, and the handle 26 is arranged with a second predetermined feature 52. The first predetermined feature 50 and the second predetermined feature 52 are a combination of a protruded part and a recessed part (or a structure formed with a space or a hole). In the present embodiment, the first predetermined feature 50 is a fixing bolt with an extension protruded part 50*a*, and the second predetermined feature 52 is a structure formed with a hole, but the present invention is not limited thereto. In addition, the auxiliary elastic member 48 is connected to the connecting component 32 on the second rail 24 in the present embodiment.

When the second rail 24 is located at the retracted position R relative to the first rail 22 and when the handle 26 is in the second state S2 (as shown in FIG. 4 and FIG. 4A), the auxiliary structure 46 and the auxiliary elastic member 48 abut against each other, such that the auxiliary elastic member 48 is configured to accumulate an auxiliary elastic force f, and the first predetermined feature 50 (the extension protruded part 50*a* of the fixing bolt) is not engaged with the second predetermined feature 52 (the hole of the structure) as shown in FIG. 4 and FIG. 4A.

Figure 5A:
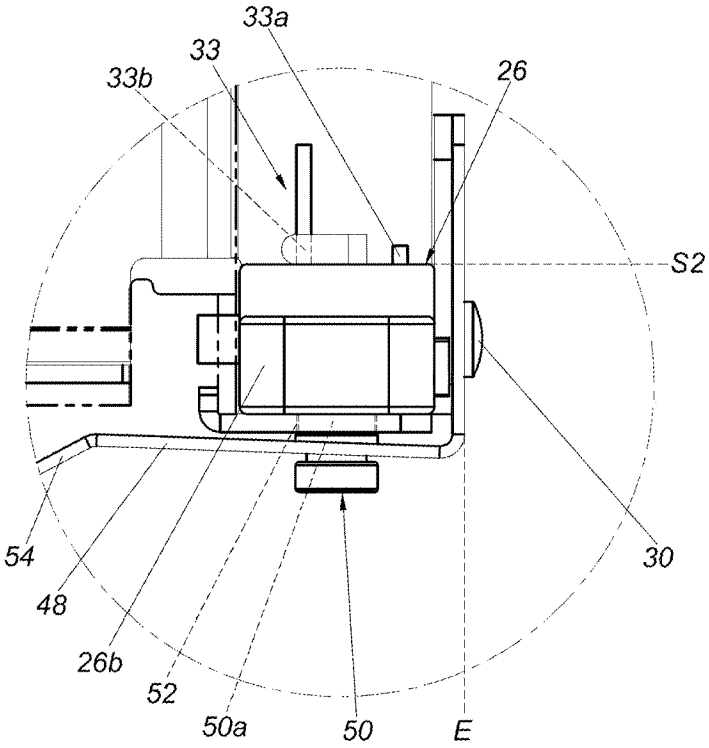
FIG. 5A is an enlarged view of an area A of FIG. 5.
Figure 5:
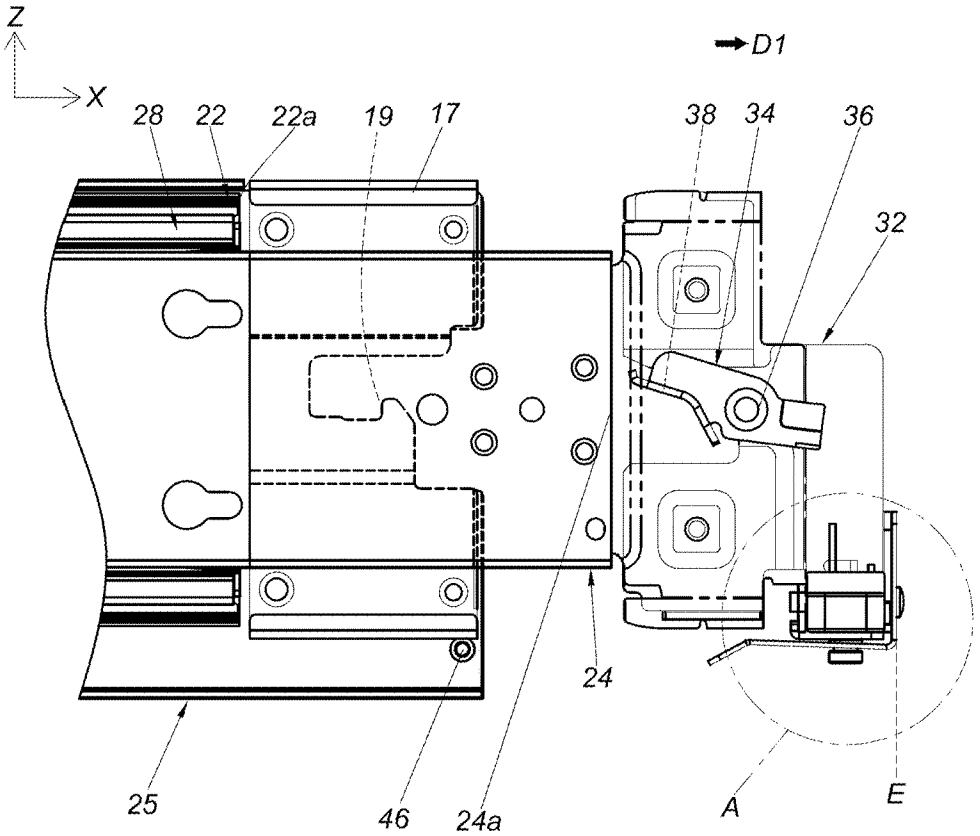
FIG. 5 is a diagram showing the second rail being moved to an extended position along an opening direction relative to the first rail of the slide rail assembly with the handle in the second state according to the first embodiment of the present invention.

As shown in FIG. 4 and FIG. 5, when the second rail 24 is moved a predetermined distance from the retracted position R (as shown in FIG. 4 and FIG. 4A) to an extended position E along the opening direction D1 relative to the first rail 22 (as shown in FIG. 5 and FIG. 5A), the auxiliary structure 46 and the auxiliary elastic member 48 no longer abut against each other, such that the first predetermined feature 50 is engaged with the second predetermined feature 52 in response to the auxiliary elastic force f being released by the auxiliary elastic member 48. For example, the first predetermined feature 50 (the extension protruded part 50*a* of the fixing bolt) is inserted into the second predetermined feature 52 (the hole of the structure) in order to hold the handle 26 in the second state S2 (as shown in FIG. 5 and FIG. 5A). In other words, the elastic member 33 is configured to be held in a state of accumulating an elastic force through mutually engaging the first predetermined feature 50 with the second predetermined feature 52.

Figure 6:
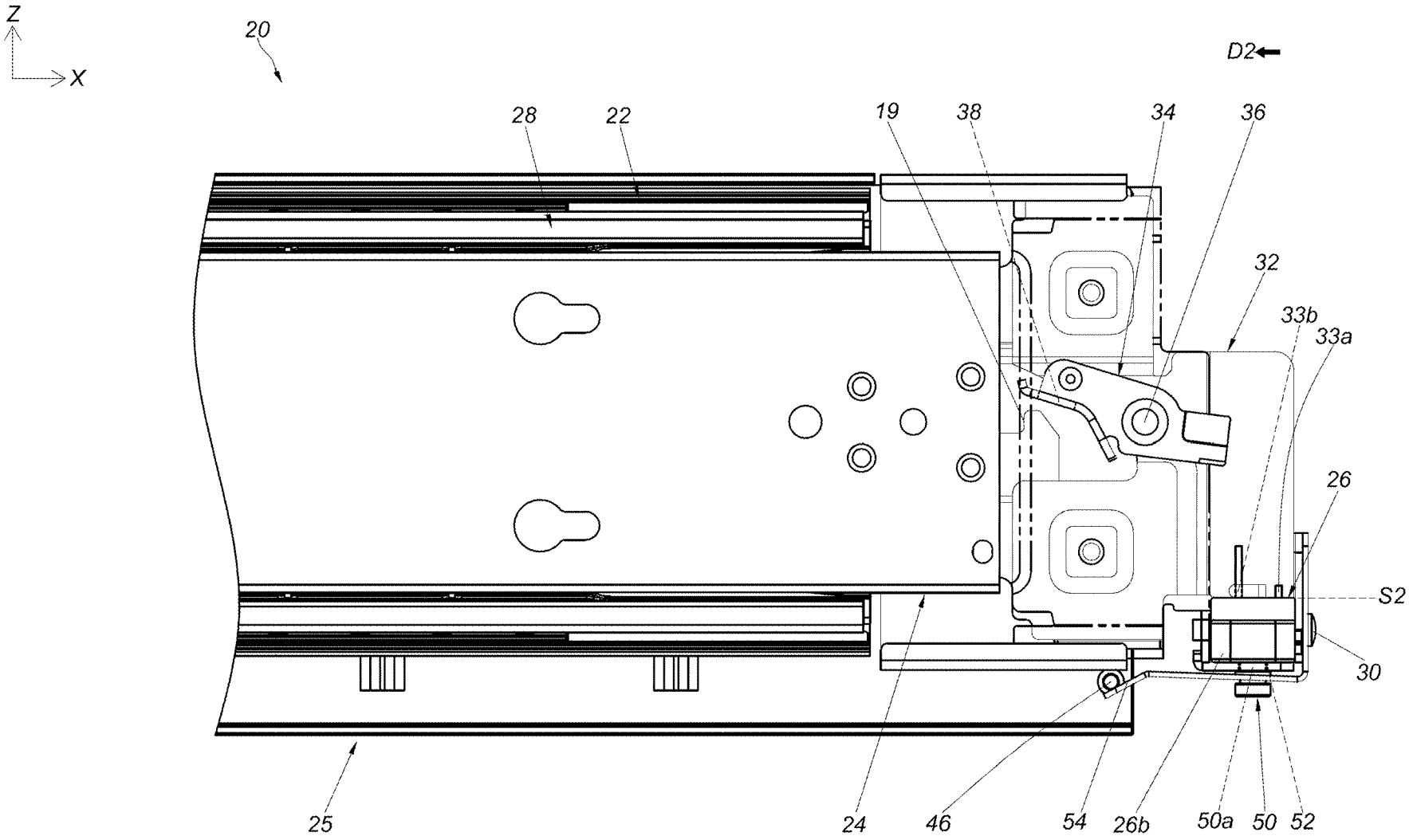
FIG. 6 is a diagram showing the second rail being moved from the extended position to the retracted position along a retracting direction relative to the first rail of the slide rail assembly with the handle in the second state according to the first embodiment of the present invention.

As shown in FIG. 5 and FIG. 6, one end of the auxiliary elastic member 48 is arranged with a guiding section 54 (such as an inclined surface or an arc surface). During a process of the second rail 24 being moved from the extended position E (as shown in FIG. 5 and FIG. 5A) to the retracted position R along a retracting direction D2 relative to the first rail 22 (as shown in FIG. 6), the auxiliary elastic member 48 is configured to abut against the auxiliary structure 46 on the first rail 22 through the guiding section 54 (please refer to FIG. 6), so as to drive the first predetermined feature 50 to move to disengage the first predetermined feature 50 (the extension protruded part 50*a* of the fixing bolt) from the second predetermined feature 52 (as shown in FIG. 4 and FIG. 4A), in order to allow the handle 26 to return to the first state S1 (as shown in FIG. 3 and FIG. 3A) from the second state S2 (as shown in FIG. 4 and FIG. 4A). Preferably, the handle 26 is driven to move to switch from the second state S2 to the first state S1 in response to the elastic force being released by the elastic member 33. During a process of the handle 26 returning to the first state S1 from the second state S2, the supporting feature 40 of the handle 26 is configured to contact the extension part 44 of the locking member 34 through the guiding part (such as an inclined surface or an arc surface), so as to drive the locking member 34 to move back to the state being blocked by the blocking part 19. As such, the second rail 24 is locked at the retracted position R relative to the first rail 22 again (as shown in FIG. 3 and FIG. 3A).

In addition, when the second rail 24 is moved back to the retracted position R relative to the first rail 22 (as shown in FIG. 3 and FIG. 3A), the auxiliary structure 46 and the auxiliary elastic member 48 abut against each other again, such that the auxiliary elastic member 48 accumulates the auxiliary elastic force f again.

Figure 7:
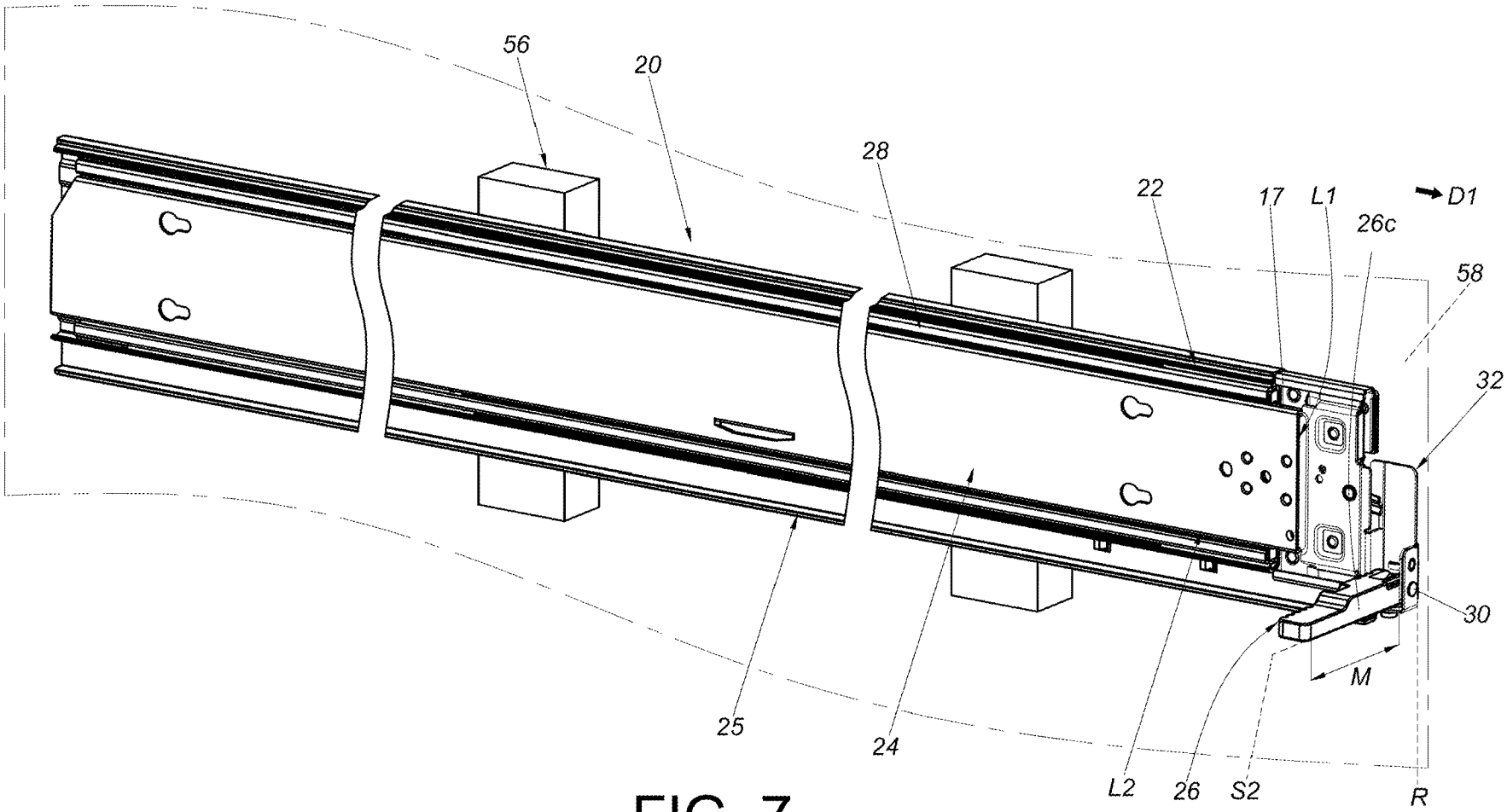
FIG. 7 is a diagram showing the slide rail assembly being mounted to a rack according to the first embodiment of the present invention.

AS shown in FIG. 7, the slide rail assembly 20 is mounted to a rack 56 (or a cabinet). For example, the first rail 22 is configured to be mounted to at least one post of the rack 56 through the bracket 25, and the second rail 24 is configured to carry a carried object (not shown). However, for different structural design or specific requirement, some part of the rack 56 (such as a wall part 58) may block at an outer side of the slide rail assembly 20. Therefore, the handle 26 provided in the present embodiment is configured to be moved toward an inner side of the slide rail assembly 20 (such as toward the inner side L2 of the second rail 24) by the user to switch from the first state S1 to the second state S2, such that the second rail 24 can be easily pulled out along the opening direction D1 relative to the first rail 22 without being affected by the wall part 58.

Furthermore, when the handle 26 is in the second state S2, the operating section 26*c* of the handle 26 is extended beyond the inner side L2 of the second rail 24 by a predetermined distance M, and the user can hold the operating section 26*c* of the handle 26 with his hand to apply a force F along the opening direction D1, so as to easily and conveniently pull out the second rail 24 from the retracted position R along the opening direction D1 relative to the first rail 22.

FIG. 8 to FIG. 12 show a slide rail assembly 200 according to a second embodiment of the present invention. The difference between the slide rail assembly 200 of the second embodiment and the slide rail assembly 20 of the first embodiment substantially lies in structural design of the handle 201.

Figure 8:
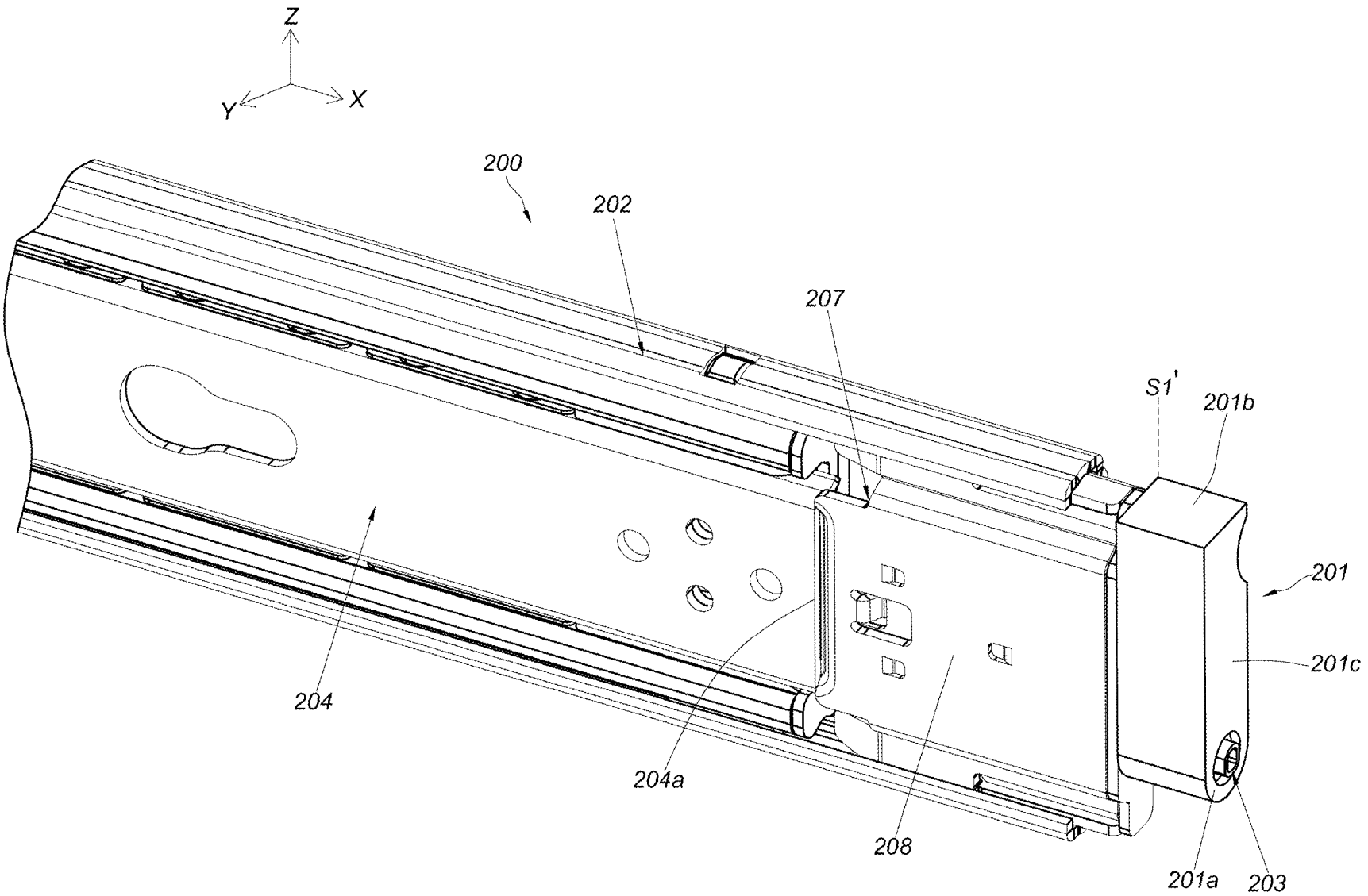
FIG. 8 is a diagram showing a slide rail assembly with a handle in a first state according to a second embodiment of the present invention.
Figure 9:
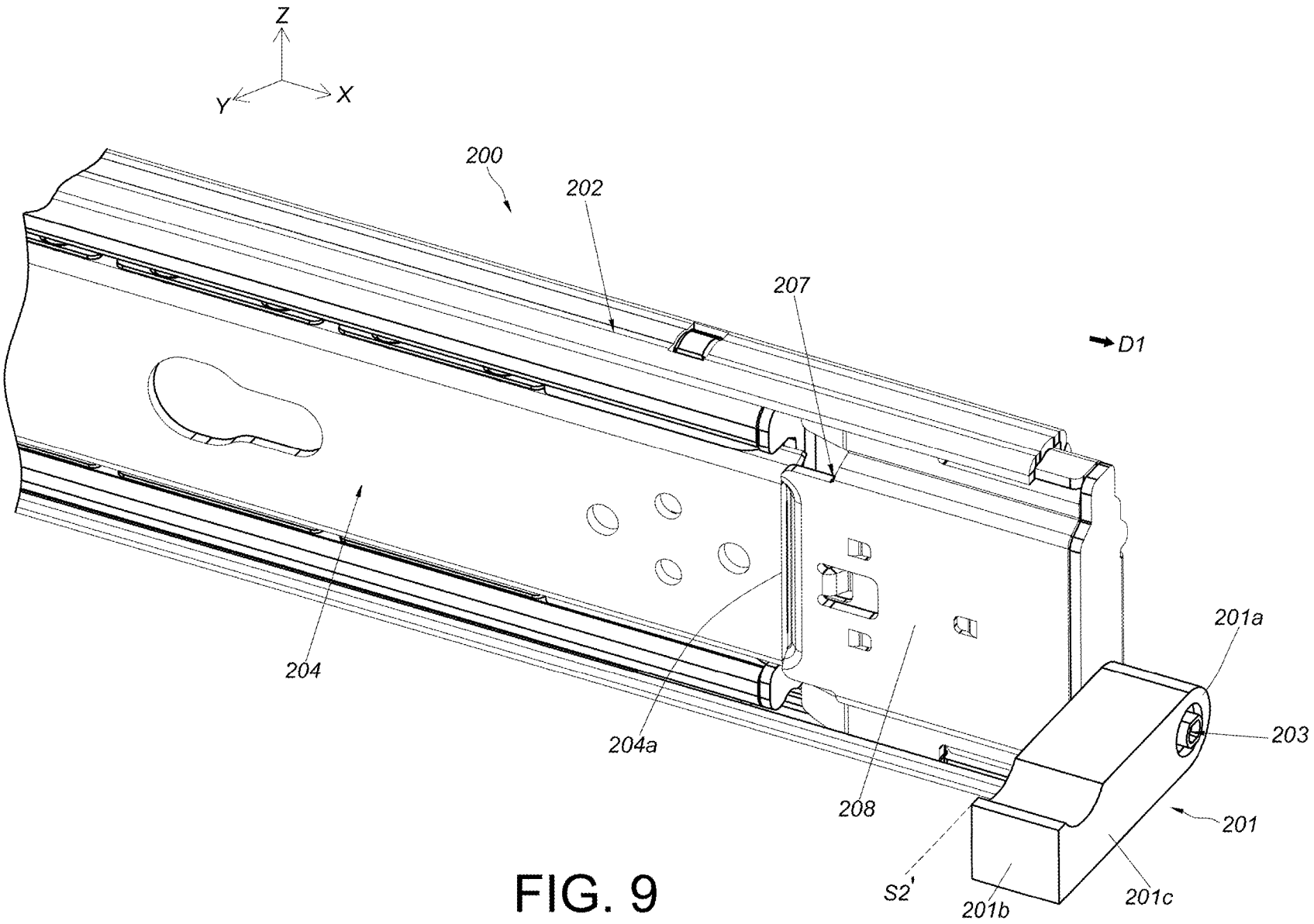
FIG. 9 is a diagram showing the slide rail assembly with the handle in a second state according to the second embodiment of the present invention.
Figure 10:
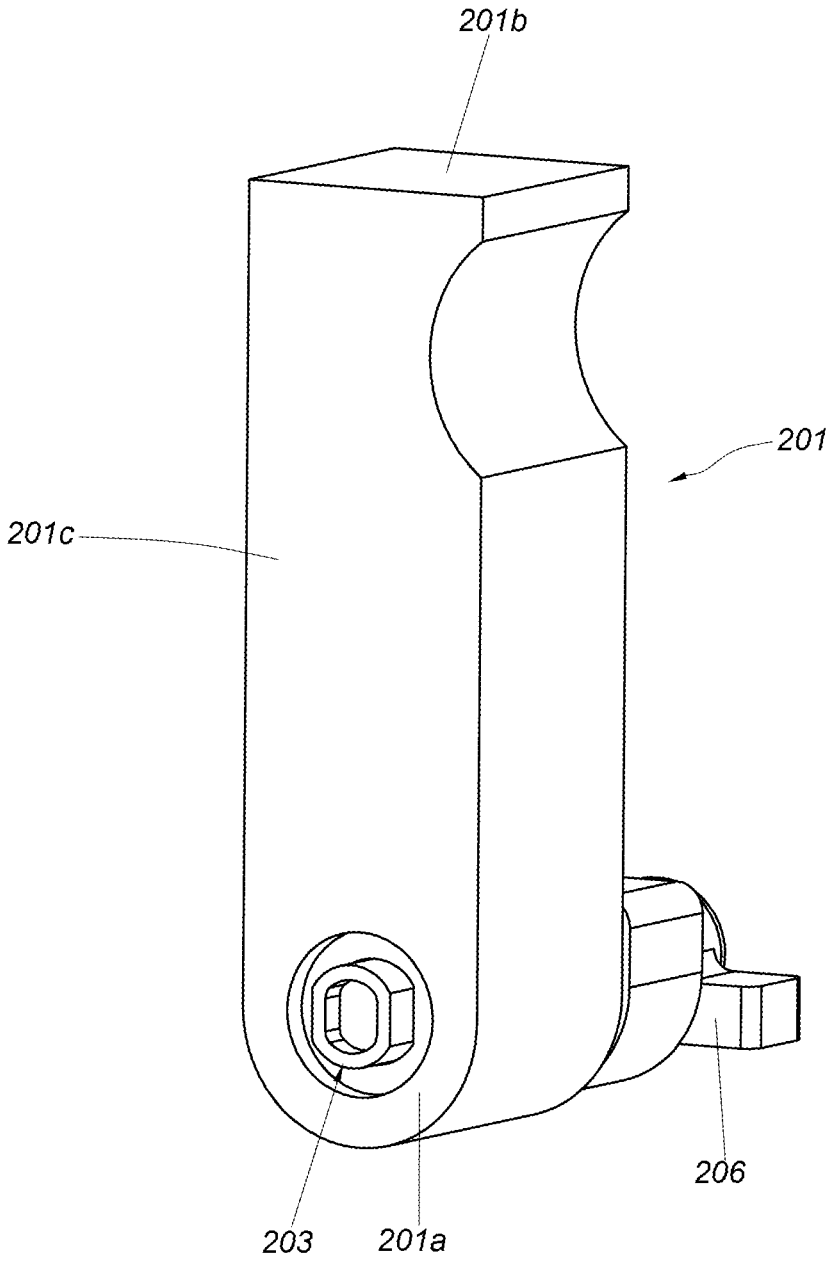
FIG. 10 is a diagram showing the handle according to the second embodiment of the present invention.

As shown in FIG. 8 to FIG. 10, the handle 201 comprises a first end 201*a*, a second end 201*b* and an operating section 201*c* connected between the first end 201*a* and the second end 201*b* (as shown in FIG. 8 and FIG. 9). Similar to the first embodiment, the handle 201 is pivoted to a second rail 204 through a shaft member 203, such that the handle 201 is movable to switch between a first state S1' (as shown in FIG. 8) and a second state S2' (as shown in FIG. 9). The handle 201 is arranged with a driving part 206, such as a protrusion (as shown in FIG. 10). Similar to the first embodiment, a first end 204*a* of the second rail 204 is arranged with a connecting component 207 (as shown in FIG. 8 or FIG. 9), and the handle 201 is pivotally connected to the connecting component 207 on the second rail 204 through the shaft member 203. The connecting component 207 is connected (such as fixedly connected) to the second rail 204 to be seen as a part of the second rail 204. The connecting component 207 comprises a casing 208, and the casing 208 accommodates a locking member 210 (as shown in FIG. 11).

Figure 11:
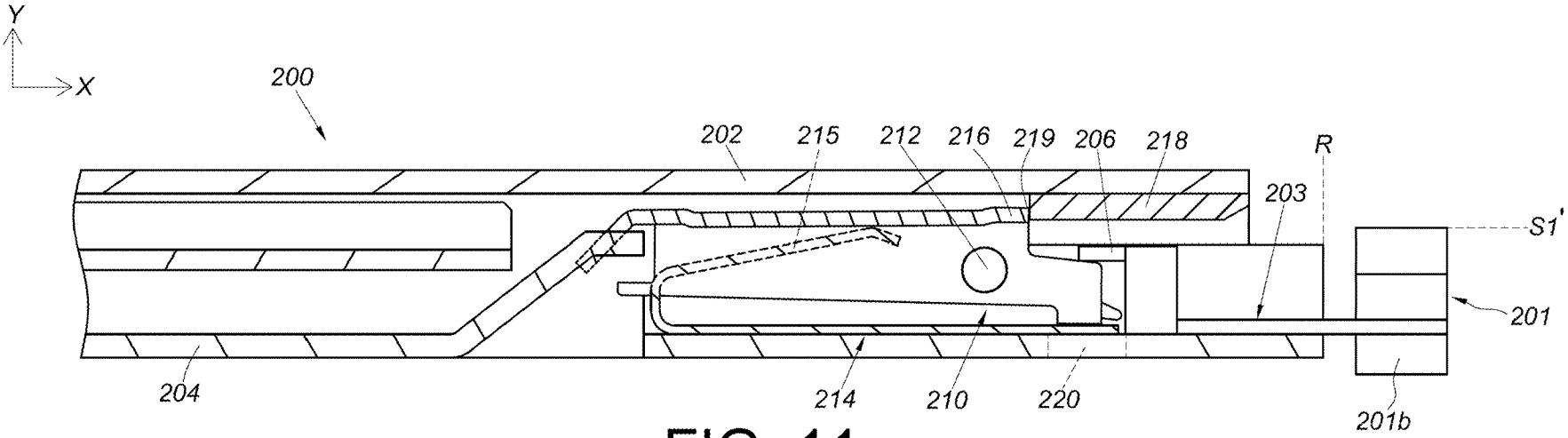
FIG. 11 is a diagram showing a second rail located at a retracted position relative to a first rail of the slide rail assembly with the handle in the first state according to the second embodiment of the present invention.
Figure 12:
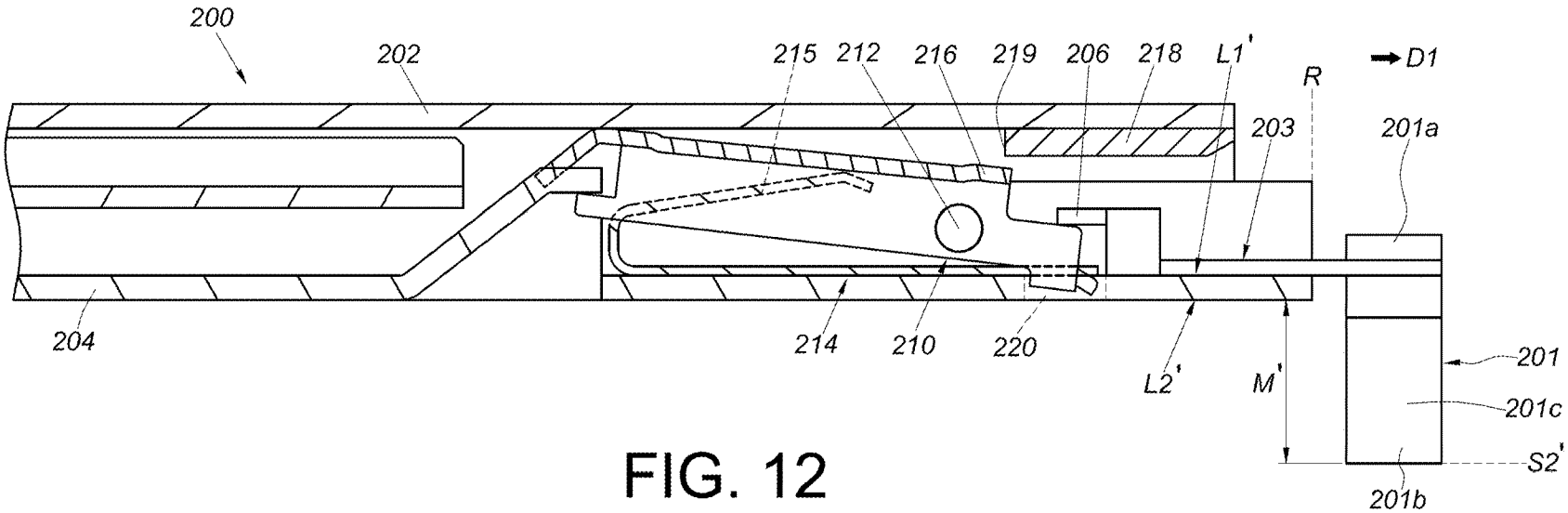
FIG. 12 is a diagram showing the second rail located at the retracted position relative to the first rail of the slide rail assembly with the handle in the second state configured to unlock the second rail from the first rail according to the second embodiment of the present invention.

As shown in FIG. 11 and FIG. 12, the locking member 210 is movably mounted on the second rail 204. In the present embodiment, the locking member 210 is pivoted to the connecting component 207 of the second rail 204 through an auxiliary shaft 212. Different from the first embodiment, the auxiliary shaft 212 of the second embodiment is arranged in a direction substantially identical to a height direction of the second rail 204 (or the aforementioned Z-axis direction).

Preferably, the slide rail assembly 200 further comprises an elastic member 214 configured to provide an elastic force to the locking member 210. For example, the elastic member 214 can be an elastic piece, or other type of component with elasticity. Configuration and structure of the elastic member 214 is not limited. The elastic member 214 comprises an elastic part 215 configured to provide the elastic force to the locking member 210, such that a locking part 216 of the locking member 210 can be held in a state of being blocked by a blocking section 219 (or a blocking wall) of a blocking part 218 of a first rail 202 (or a bracket of the first rail 202), in order to prevent the second rail 204 from being moved away from the retracted position R relative to the first rail 202 (as shown in FIG. 11).

Preferably, the elastic force of the elastic member 214 not only can hold the locking part 216 of the locking member 210 to be blocked by the blocking part 218, but also can hold the handle 201 in the first state S1' through the driving part 206 and the locking member 210 abutting against each other. In other words, the handle 201 is configured to be held in the first state S1' in response to the elastic force of the elastic member 214 (as shown in FIG. 11).

Furthermore, when the handle 201 is moved to switch from the first state S1' (as shown in FIG. 11) to the second state S2' (as shown in FIG. 12), the driving part 206 of the handle 201 is configured to drive the locking member 210 to rotate a predetermined angle, such that the locking part 216 of the locking member 210 is no longer blocked by the blocking part 218, in order to allow the second rail 204 to be moved away from the retracted position R along the opening direction D1 relative to the first rail 202 (shown in FIG. 12). Preferably, the second rail 204 is formed with a corresponding hole 220. When the locking member 210 is rotated the predetermined angle, a portion of the locking member 210 is configured to be extended into the corresponding hole 220, so as to provide space for the locking member 210 to move.

When the handle 201 is in the second state S2', the operating section 201*c* of the handle 201 is extended beyond an inner side L2' of the second rail 204 by a predetermined distance M' (as shown in FIG. 12). The user can hold the operating section 201*c* of the handle 201 with his hand to apply a force along the opening direction D1, so as to easily and conveniently pull out the second rail 204 from the retracted position R along the opening direction D1 relative to the first rail 202.

Figure 13:
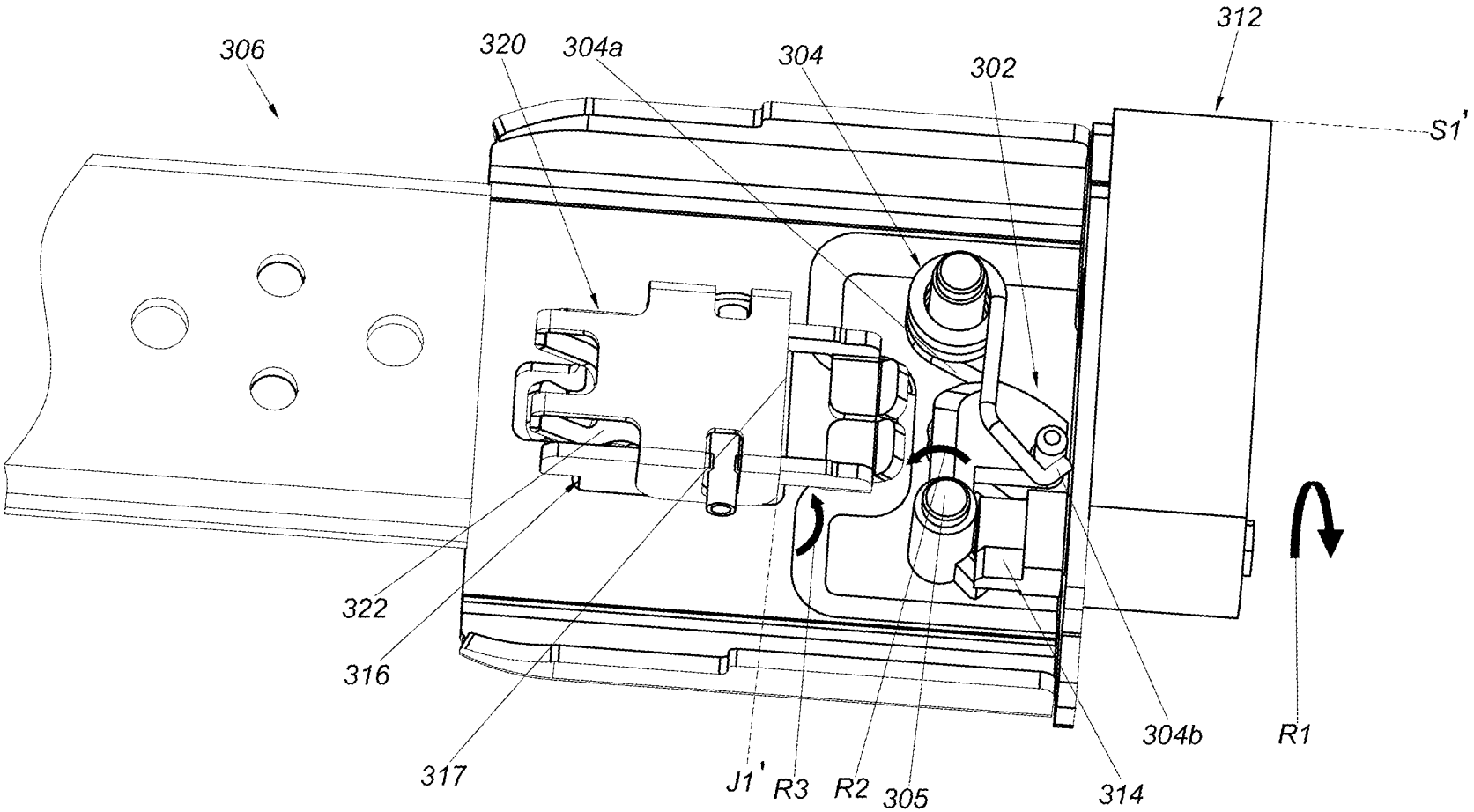
FIG. 13 is a diagram showing a second rail of a slide rail assembly further arranged with a working member, a locking member in a locking state and an elastic feature configured to work with the working member according to a third embodiment of the present invention.
Figure 14:
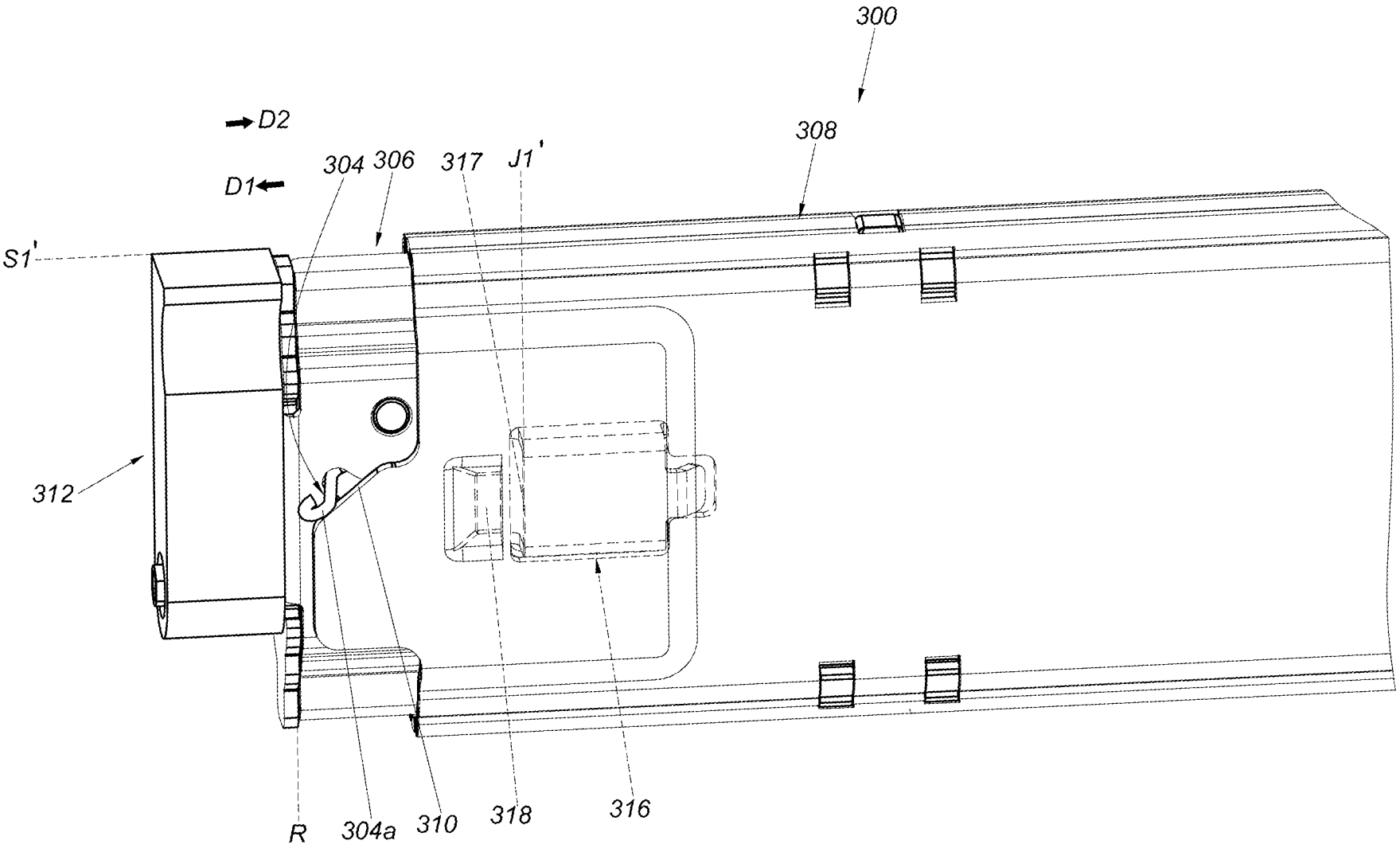
FIG. 14 is a diagram showing the second rail located at a retracted position relative to a first rail of the slide rail assembly with the locking member in the locking state according to the second embodiment of the present invention.
Figure 15:
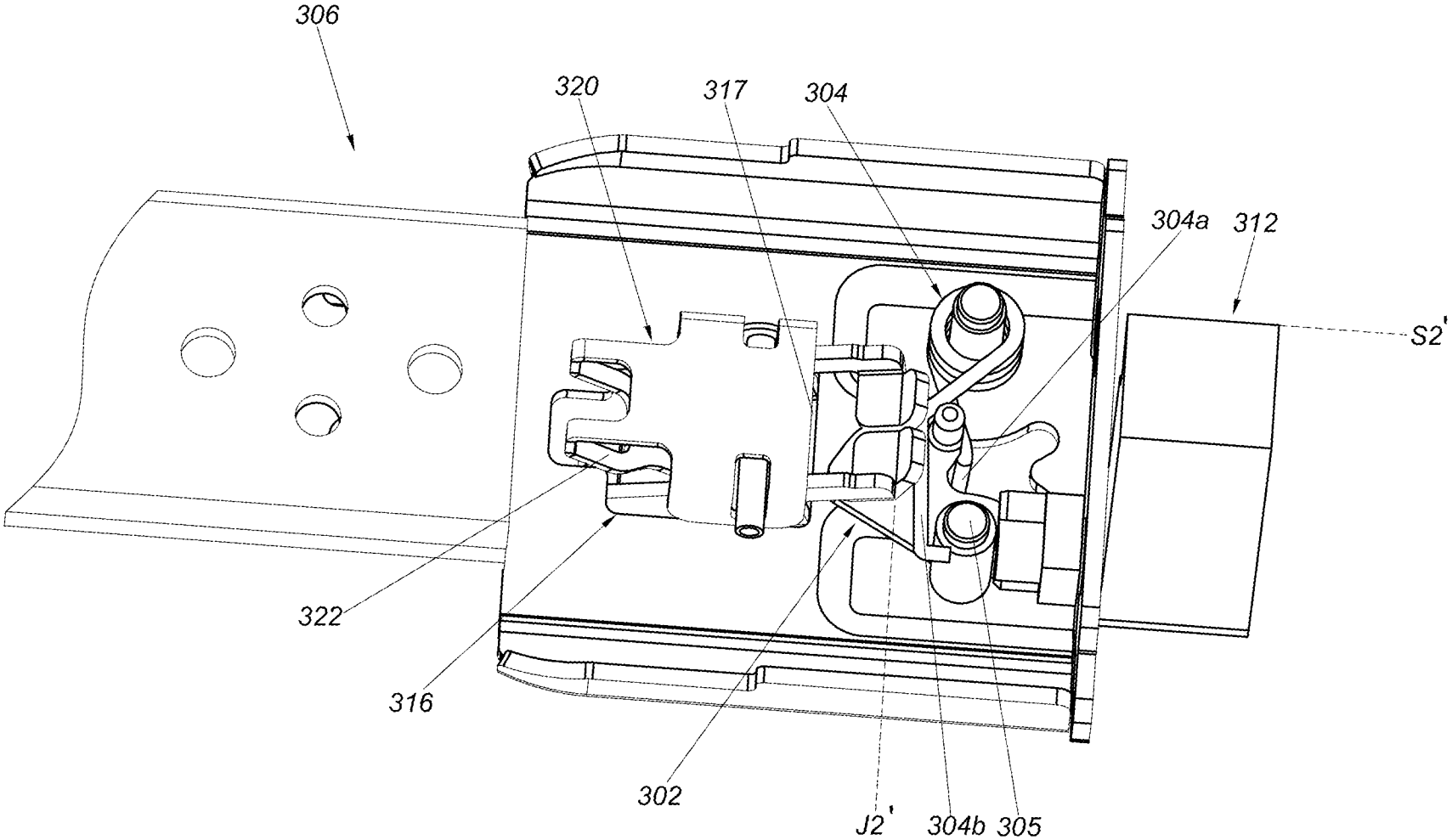
FIG. 15 is a diagram showing the locking member on the second rail of the slide rail assembly being in an unlocking state according to the third embodiment of the present invention.

FIG. 13 to FIG. 15 show a slide rail assembly 300 according to a third embodiment of the present invention. A first rail 308 of the slide rail assembly 300 shown in FIG. 14 is omitted in FIG. 13 and FIG. 15. The difference between the slide rail assembly 300 of the third embodiment and the slide rail assembly 200 of the second embodiment substantially lies in the slide rail assembly 300 further comprising a working member 302 and an elastic feature 304. The working member 302 is pivoted to a second rail 306 through a shaft part 305, and the shaft part 305 is arranged in a direction substantially identical to a transverse direction of the second rail 306 (or the Y axis direction). The elastic feature 304 comprises a first elastic part 304*a* and a second elastic part 304*b*.

When the second rail 306 is located at the retracted position R relative to the first rail 308 (as shown in FIG. 14 and FIG. 13), the first elastic part 304*a* of the elastic feature 304 is configured to contact a predetermined structure 310 (such as a structure having an inclined surface or an arc surface shown in FIG. 14) of the first rail 308, and the second elastic part 304*b* of the elastic feature 304 is configured to contact the working member 302 (as shown in FIG. 13), such that the elastic feature 304 is configured to provide an elastic force to a handle 312 through the working member 302 and a portion of the handle 312 (such as a driving part 314) to hold the handle 312 in the first state S1' (as shown in FIG. 13 and FIG. 14).

During a process of the handle 312 being rotated along a first rotating direction R1 to switch from the first state S1' (as shown in FIG. 13) to the second state S2' (as shown in FIG. 15), the handle 312 is configured to drive a locking member 316 to rotate along a third rotating direction R3 to switch from a locking state J1' (as shown in FIG. 13 and FIG. 14) to an unlocking state J2' (as shown in FIG. 15) through the driving part 314 driving the working member 302 to rotate along a second rotating direction R2, such that a locking part 317 of the locking member 316 is no longer blocked by a blocking part 318 of the first rail 308, in order to allow the second rail 306 to be moved away from the retracted position R along the opening direction D1 relative to the first rail 308 (as shown in FIG. 14). Moreover, when the second rail 306 is moved away from the retracted position R along the opening direction D1 relative to the first rail 308 (or located at an extended position), the first elastic part 304*a* of the elastic feature 304 no longer contacts the predetermined structure 310 of the first rail 308, such that the elastic feature 304 no longer provides the elastic force to the handle 312 through the working member 302 and the driving part 314 of the handle 312, so as to allow the handle 312 to stay in the second state S2', and allow the locking member 316 to stay in the unlocking state J2' (as shown in FIG. 15).

When the second rail 306 is moved to return to the retracted position R from the extended position relative to the first rail 308 along a retracting direction D2, the first elastic part 304*a* of the elastic feature 304 contacts the predetermined structure 310 of the first rail 308 again (as shown in FIG. 14), such that the elastic feature 304 is configured to provide the elastic force to the handle 312 through the working member 302 and the driving part 314 of the handle 312 (as shown in FIG. 13), in order to drive the handle 312 to move to switch from the second state S2' (as shown in FIG. 15) to the first state S1'. Moreover, the locking member 316 is correspondingly moved back to the locking state J1' in response to an elastic force provided by an elastic part 322 of an elastic member 320.

Therefore, the slide rail assembly according to the embodiments of the present invention has the following technical features:

1. The handle (26, 201, 312) is pivoted to the second rail (24, 204, 306) through a shaft member (30, 203), such that the handle (26, 201, 312) is movable to switch between the first state (S1, S1') and the second state (S2, S2'). The shaft member (30, 203) is arranged in a direction substantially identical to a moving direction (or the longitudinal direction) of the second rail (24, 204, 306) relative to the first rail (22, 202, 308), such that the handle (26, 201, 312) can be moved toward the inner side of the slide rail assembly (20, 200, 300) by the user to switch from the first state (S1, S1') to the second state (S2, S2'), so as to allow the user to easily and conveniently pull out the second rail (24, 204, 306) from the retracted position R along the opening direction D1 relative to the first rail (22, 202, 308).

2. When the handle (26, 201, 312) is in the second state (S2, S2'), the operating section (26*c*, 201*c*) of the handle (26, 201, 312) is extended beyond the inner side (L2, L2') of the second rail (24, 204, 306) by a predetermined distance (M, M'), and the user can hold the operating section (26*c*, 201*c*) of the handle (26, 201, 312) with his hand to apply a force along the opening direction D1, so as to easily and conveniently pull out the second rail (24, 204, 306) from the retracted position R along the opening direction D1 relative to the first rail (22, 202, 308).

3. The second rail (24, 204, 306) located at the retracted position R relative to the first rail (22, 202, 308) can be unlocked from the first rail (22, 202, 308) through operating the handle (26, 201, 312).

4. In the first embodiment, the first rail 22 is arranged with the auxiliary structure 46, the second rail 24 is arranged with the auxiliary elastic member 48, the auxiliary elastic member 48 is arranged with the first predetermined feature 50, and the handle 26 is arranged with the second predetermined feature 52. When the second rail 24 is located at the retracted position R relative to the first rail 22 and when the handle 26 is in the second state S2, the auxiliary structure 46 is configured to abut against the auxiliary elastic member 48, such that the auxiliary elastic member 48 accumulates the auxiliary elastic force, and the first predetermined feature 50 is prevented from engaging with the second predetermined feature 52. When the second rail 24 is moved a predetermined distance from the retracted position R along the opening direction D1 relative to the first rail 22 (such as being moved to the extended position E), the auxiliary structure 46 no longer abuts against the auxiliary elastic member 48, such that the auxiliary elastic member 48 releases the auxiliary elastic force to drive the first predetermined feature 50 to engage with the second predetermined feature 52, in order to hold the handle 26 in the second state S2. During the process of the second rail 24 being moved from the extended position E to the retracted position R along the retracting direction D2 relative to the first rail 22, the auxiliary elastic member 48 is driven by the auxiliary structure 46 to disengage the first predetermined feature 50 from the second predetermined feature 52, in order to allow the handle 26 to switch from the second state S2 back to the first state S1. Preferably, the handle 26 returns to the first state S1 from the second state S2 in response to the elastic force of the elastic member 33.

5. In the first embodiment, the elastic force of the elastic member 33 can be directly applied to the handle 26, such that the handle 26 is held in the first state S1 in response to the elastic force of the elastic member 33. Or in the second embodiment, the elastic force of the elastic member 214 can be indirectly applied to the handle 201 through the locking member 210 to hold the handle 201 in the first state S1'.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail;

a second rail movable relative to the first rail; and a handle pivoted to the second rail through a shaft member and movable relative to the second rail to switch between a first state and a second state;

wherein the shaft member is arranged in a direction substantially identical to a moving direction of the second rail relative to the first rail;

wherein the second rail has an outer side and an inner side opposite to each other, the outer side is adjacent to and faces toward the first rail; the handle has a first end, a second end and an operating section connected between the first end and the second end; wherein when the handle is in the second state, the operating section of the handle is configured to be held by a user to pull out the second rail from a retracted position along an opening direction relative to the first rail;

wherein the first rail comprises a blocking part, and the slide rail assembly further comprises a locking member movably mounted on the second rail; wherein when the second rail is located at the retracted position relative to the first rail, the locking member is configured to be blocked by the blocking part in order to prevent the second rail from being moved away from the retracted position;

wherein the handle has a supporting feature; wherein when the second rail is located at the retracted position relative to the first rail and when the handle is in the first state, the supporting feature of the handle is configured to support the locking member;

during a process of the handle being moved to switch from the first state to the second state, the supporting feature of the handle no longer supports the locking member, such that the locking member is no longer blocked by the blocking part.

2. The slide rail assembly of claim 1, wherein when the handle is in the first state, the handle is arranged in a direction substantially identical to a height direction of the second rail.

3. The slide rail assembly of claim 2, wherein when the handle is in the second state, the handle is arranged in a direction substantially identical to a transverse direction of the second rail.

4. The slide rail assembly of claim 3, wherein the moving direction of the second rail, the height direction of the second rail and the transverse direction of the second rail are perpendicular to each other.

5. The slide rail assembly of claim 1, wherein the first rail is arranged with an auxiliary structure, the second rail is arranged with an auxiliary elastic member, the auxiliary elastic member is arranged with a first predetermined feature, and the handle is arranged with a second predetermined feature; wherein when the second rail is located at the retracted position relative to the first rail and when the handle is in the second state, the auxiliary structure is configured to abut against the auxiliary elastic member, such that the auxiliary elastic member accumulates an auxiliary elastic force, and the first predetermined feature is prevented from engaging with the second predetermined feature.

6. The slide rail assembly of claim 5, wherein when the second rail is moved a predetermined distance from the retracted position along the opening direction relative to the first rail, the auxiliary structure no longer abuts against the auxiliary elastic member, such that the auxiliary elastic member releases the auxiliary elastic force to drive the first predetermined feature to engage with the second predetermined feature, in order to hold the handle in the second state.

7. The slide rail assembly of claim 6, wherein during a process of the second rail being moved from an extended position to the retracted position along a retracting direction relative to the first rail, the auxiliary elastic member is driven by the auxiliary structure to disengage the first predetermined feature from the second predetermined feature, in order to allow the handle to switch from the second state to the first state.

8. The slide rail assembly of claim 7, further comprising an elastic member;

wherein when the first predetermined feature is disengaged from the second predetermined feature, the elastic member is configured to provide an elastic force to drive the handle to switch from the second state to the first state.

9. A slide rail assembly, comprising:

a first rail;

a second rail movable relative to the first rail; and a handle movable relative to the second rail to switch between a first state and a second state;

wherein the second rail has an outer side and an inner side opposite to each other, the outer side is adjacent to and faces toward the first rail;

wherein the handle has a first end, a second end and an operating section connected between the first end and the second end; wherein when the handle is in the second state, the operating section of the handle is extended beyond the inner side of the second rail by a predetermined distance;

wherein the first rail comprises a blocking part, and the slide rail assembly further comprises a locking member movably mounted on the second rail; wherein when the second rail is located at a retracted position relative to the first rail, the locking member is configured to be blocked by the blocking part in order to prevent the second rail from being moved away from the retracted position;

wherein the handle has a supporting feature; wherein when the handle is in the first state, the supporting feature of the handle is configured to support the locking member;

during a process of the handle being moved to switch from the first state to the second state, the supporting feature of the handle no longer supports the locking member, such that the locking member is no longer blocked by the blocking part;

wherein the slide rail assembly further comprises an elastic member, the elastic member is configured to provide an elastic force to drive the handle to switch from the second state to the first state.

10. The slide rail assembly of claim 9, wherein the handle is pivoted to the second rail through a shaft member, the shaft member is adjacent to the first end and arranged in a direction substantially identical to a moving direction of the second rail relative to the first rail.

11. The slide rail assembly of claim 9, wherein when the handle is in the first state, the handle is arranged in a direction substantially identical to a height direction of the second rail.

12. The slide rail assembly of claim 9, wherein when the handle is in the second state, the handle is arranged in a direction substantially identical to a transverse direction of the second rail.

* * * * *